US007504588B2

(12) United States Patent
Robberding

(10) Patent No.: US 7,504,588 B2
(45) Date of Patent: Mar. 17, 2009

(54) ACOUSTICALLY TRANSPARENT STRANDED CABLE

(75) Inventor: Keith Robberding, 1029 Gilman Dr., Daly City, CA (US) 94015

(73) Assignee: Keith Robberding, Daly City, CA (US)

( * ) Notice: Subject to any disclaimer, the term of this patent is extended or adjusted under 35 U.S.C. 154(b) by 0 days.

(21) Appl. No.: 11/768,008

(22) Filed: Jun. 25, 2007

(65) Prior Publication Data

US 2008/0314615 A1 Dec. 25, 2008

(51) Int. Cl.
*H01B 5/08* (2006.01)

(52) U.S. Cl. ..... 174/128.1

(58) Field of Classification Search ..... 174/128.1, 174/128.2, 113 R
See application file for complete search history.

(56) References Cited

U.S. PATENT DOCUMENTS 4,208,542 A 6/1980 Endo
4,501,185 A 2/1985 Blucher
4,538,023 A * 8/1985 Brisson ..... 174/115
4,814,548 A 3/1989 Traversino et al.
5,274,712 A 12/1993 Lindsay et al.
5,298,682 A * 3/1994 Salz ..... 174/105 R
5,796,821 A 8/1998 Crouch et al.
6,399,885 B1 6/2002 Agostinelli
6,476,328 B2 11/2002 Agostinelli
6,545,213 B1 4/2003 Gabriel
6,888,057 B2 5/2005 Juszkiewicz et al.
6,974,912 B2 12/2005 Selby
7,141,740 B2 * 11/2006 Ko ..... 174/128.1
7,170,008 B2 1/2007 Victor
2002/0053459 A1 5/2002 Agostinelli
2004/0023552 A1 2/2004 Chen (Continued)

OTHER PUBLICATIONS

Reade Advanced Materials, "Wire Gauge / Gage Conversion Chart", www.reade.com, 2006.

*Primary Examiner*—Chau N Nguyen
(74) *Attorney, Agent, or Firm*—Michael A. Glenn; Glenn Patent Group

(57) ABSTRACT

A cable having universal applications for transmitting any kind of electrical signal, including AC and DC power, for sensitive test instruments cables and, particularly, for conducting audio, video and digital signals through a stranded metal wire conductor can consist of virtually any configuration, or randomly-no configuration. The cable can be shielded or unshielded to suit personal preferences or specific applications. The cable is made from wire that can be braided in any Litz wire configuration that provides a desired number of twists per foot. The cable can be used to transmit any type of electrical signal with the results dependent on which gauge of wire listed below is used. The following list includes twenty one gauges of wire which are significant because they represent the lowest to highest performance capabilities in my cable and are numbered low to high for this purpose, starting with gauge 40, and finishing with gauge 60. These gauges of wire represent a progressively better and more accurate electrical signal transducer with each higher numbered gauge: 40, 41, 42, 43, 44, 45, 46, 47, 48, 49, 50, 51, 52, 53, 54, 55, 56, 57, 58, 59, 60. In the preferred embodiment, the main determining factor in performance is the specific gauge of wire in use. Thus, a 40 gauge wire is lower in performance, with a 60 gauge wire having the theoretical highest performance. The cable can be made with air as a dielectric or any other type of jacketing can be used.

6 Claims, 1 Drawing Sheet

U.S. PATENT DOCUMENTS

2005/0011667 A1 1/2005 Lee et al.
2005/0121222 A1* 6/2005 Lee ..... 174/113 R
2005/0194177 A1 9/2005 Selby
2006/0185886 A1 8/2006 Victor

* cited by examiner

ACOUSTICALLY TRANSPARENT STRANDED CABLE

BACKGROUND OF THE INVENTION

1. Technical Field

The invention relates to the reproduction of audio signals. More particularly, the invention relates to an acoustically transparent stranded cable for interconnecting components in an audio signal path.

2. Description of the Prior Art

As long as people have been listening to recorded music and using cables to connect various audio components together, there has been much effort put into improving the way electrical signals that represent the recorded music are transmitted between these audio components. The ultimate purpose of such cables is to do virtually nothing in the signal path, i.e. to provide a transparent path for the electrical signals to travel. The closer one comes to this end, the better. Most efforts to date have concentrated on trying different cable construction and shielding techniques. Although different windings and shielding variations affect the way music sounds, known techniques do not reduce the massive amount of distortion that currently takes place during signal transmission. Currently, the main tests performed on such cables to determine the attributes of the cable are to measure the cable resistance, inductance, and capacitance. However, these tests do not show how accurately the electronic signal is transmitted by such cables. Because no one knows or agrees upon what measurements should be used to determine the acoustic transparency of a cable, most known cables are designed using only variables at hand, i.e. the construction technique and shielding.

The best way to determine the accuracy of an audio cable is by listening to music with a system that incorporates the cable of interest. One objective way to determine which approach to cable construction is better is by listening for reproduction of recorded information. If more recorded information can be heard, then this is an objective observation. There may be audio tests which can achieve the same results but, generally, it is not known or agreed to as to which tests are more relevant than listening for actual recorded information. The inventor has never listened for anything but the recorded information in his testing. A key problem people have in choosing which audio components to listen to is the simple fact that so much distortion is introduced via the connecting cables that an accurate appraisal of the component or recording is not possible. The choice of cables and components is thus reduced to deciding which signal coloration and distortion are more pleasurable to the ear and less damaging to sound quality. The electronic signals that transmit music or digital signals over cables, usually made of copper or silver wire, produce significant signal smearing because the signals do not arrive at a particular system node, e.g. the speakers or amplifier input, at the same microsecond in time and the sine waves that comprise the signals do not arrive in proper phase. Signal smearing is apparent when high frequencies sound shrill and harsh, and low frequencies sound boomy with little pitch definition.

It would be advantageous to provide an improved interconnect cable for audio components that addressed the problems attendant with state of the art audio interconnect cables.

SUMMARY OF THE INVENTION

The presently preferred embodiment of the invention comprises an acoustically transparent stranded cable made of thin stranded wire and used in systems for interconnecting the various components in a system that is used for listening to audio, where the signal may comprise any of an analog signal and a digital signal. The invention also comprises a stranded wire cable for use in transmitting a video signal. Thus, the cable provides an accurate electrical signal transducer that can be used to send any kind of electronic signal between two or more components. Because of the cable's design, an electronic signal can sound audibly better during reproduction after the signal is transmitted through the cable. The cable improves the objective sound performance of the signal when the cable is connected to an electronic component, when it is used as the wire in a power cord, and when it is used in a coaxial wire to transmit digital signals. An electronic signal passing through the cable behaves in such a way that the electronic signal is more precise. The inventive cable, preferably, can be individually insulated with a solderable enamel coating to prevent surface oxidation. The signal transmission performance of the cable is provided when it is used to replace virtually any wire that is presently used to transmit an electronic signal between two points.

The presently preferred embodiment of the invention comprises a cable having universal applications for transmitting any kind of electrical signal, including AC and DC power, for sensitive test instruments cables and, particularly, for conducting audio, video and digital signals through a stranded metal wire conductor. The cable can consist of virtually any configuration, or randomly-no configuration. The cable can be shielded or unshielded to suit personal preferences or specific applications. The cable is made from wire that can be braided in any Litz wire configuration that provides a desired number of twists per foot. The cable can be used to transmit any type of electrical signal with the results dependent on which gauge of wire listed below is used. The following list includes twenty one gauges of wire which are significant because they represent the lowest to highest performance capabilities in my cable and are numbered low to high for this purpose, starting with gauge 40, and finishing with gauge 60. These gauges of wire represent a progressively better and more accurate electrical signal transducer with each higher numbered gauge: 40, 41, 42, 43, 44, 45, 46, 47, 48, 49, 50, 51, 52, 53, 54, 55, 56, 57, 58, 59, 60.

In the preferred embodiment, the main determining factor in performance is the specific gauge of wire in use. Thus, a 40 gauge wire is lower in performance, with a 60 gauge wire having the theoretical highest performance. The cable can be made with air as a dielectric or any other type of jacketing can be used.

DETAILED DESCRIPTION OF THE INVENTION

Figure 1:
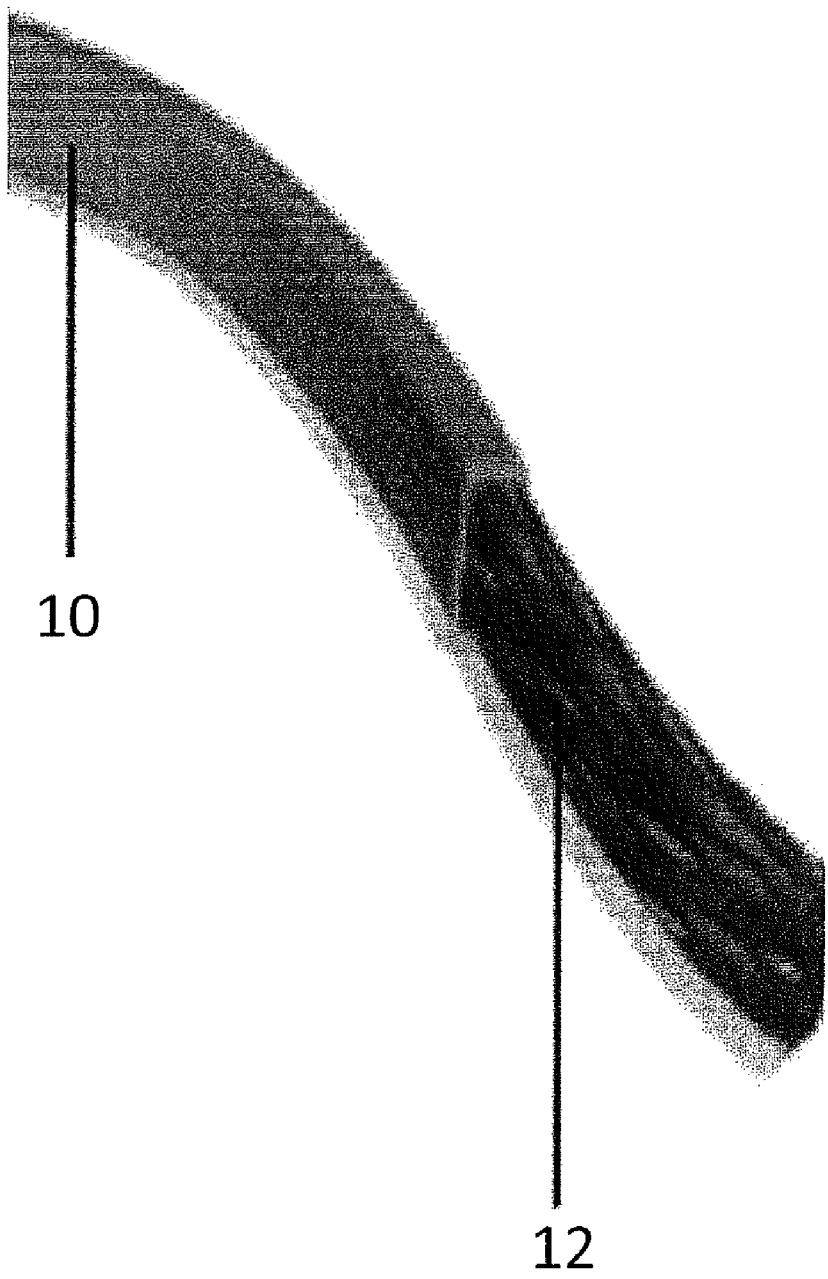
FIG. 1 is a schematic diagram showing a cable according to the invention.

The presently preferred embodiment of the invention comprises an acoustically transparent stranded cable made of thin stranded wire and used in systems for listening to audio, where the signal may comprise any of an analog signal and a digital signal. The invention also comprises a stranded wire cable for use in transmitting a video signal. Thus, the cable provides an accurate electrical signal transducer that can be used to send any kind of electronic signal between two or more components. Because of the cable's design, an electronic signal can sound audibly better during reproduction after the signal is transmitted through the cable. The cable improves the objective sound performance of the signal when the cable is connected to an electronic component, when it is used as the wire in a power cord, and when it is used in a coaxial wire to transmit digital signals. An electronic signal passing through the cable behaves in such a way that the electronic signal is more precise. The inventive cable, preferably, can be individually insulated with a solderable enamel coating to prevent surface oxidation. The signal transmission performance of the cable is provided when it is used to replace virtually any wire that is presently used to transmit an clearly and immediately audible without having to perform extended comparative listening tests.

The presently preferred embodiment of the invention comprises a cable having universal applications for transmitting any kind of electrical signal, including AC and DC power, for sensitive test instruments cables and, particularly, for conducting audio, video and digital signals through a stranded metal wire conductor. The cable can consist of virtually any configuration, or randomly-no configuration. The cable can be shielded or unshielded to suit personal preferences or specific applications. The cable is made from wire that can be braided in any Litz wire configuration that provides a desired number of twists per foot. The cable can be used to transmit any type of electrical signal with the results dependent on which gauge of wire listed below is used. The following list includes twenty one gauges of wire which are significant because they represent the lowest to highest performance capabilities in my cable and are numbered low to high for this purpose, starting with gauge 40, and finishing with gauge 60. These gauges of wire represent a progressively better and more accurate electrical signal transducer with each higher numbered gauge: 40, 41, 42, 43, 44, 45, 46, 47, 48, 49, 50, 51, 52, 53, 54, 55, 56, 57, 58, 59, 60.

In the preferred embodiment, the main determining factor in performance is the specific gauge of wire in use. Thus, a 40 gauge wire is lower in performance, with a 60 gauge wire having the theoretical highest performance. The cable can be made with air as a dielectric or any other type of jacketing can be used.

DEVELOPMENT AND A PREFERRED EMBODIMENT

In the mid-eighties, a friend invited me over to listen to his expensive, Japanese, electrostatic ear speakers (headphones). These headphones were called Stax Lambda Pro and represented the state of the art in sound reproduction at that time. When I listened to music through these headphones I was absolutely shocked at how much recorded information I heard and I immediately wondered why I wasn't coming close to hearing that much uncolored, distortion free, accurate sounding music from my speaker system. Clearly, the recorded information was on the CD's, but was lost somehow in the signal transmission. I went home and I listened to the same CD's using the headphone output from my preamplifier and the sound was still much better than what I heard from my speakers. I then listened to the CD from the headphone output from the CD player itself and it was much better still. It then occurred to me that the distortion I heard was being introduced in the wire the signal was going through. I decided to find out why.

In the mid eighties, I heard about a new cable technology called solid core cable. DNM, an English company, was touting a design using only one strand of wire in their interconnect and speaker cable. They said "Once the cross-sectional area of a cable exceeds a certain size, things begin to go badly wrong with the sound. Complex interactions between the cable and the magnetic fields generated by transmission of an electrical signal cause a circulating eddy". The wire gauges they specified for their cables were 26 gauge for interconnect and 22 gauge for speaker cable. I purchased some of their wire and found it to be effective in improving the sound. After listing to these two gauges of wire I decided to experiment to see what I could come up with. I proceeded to make up interconnects and speaker cable out of the following gauges: 20, 18, 16, 14, and 12. As each gauge increased in size, the sound became less precise with high frequencies rolling off and disappearing and base frequencies becoming slow and less defined. I made up speaker cable using 1 strand of 24 gauge wire and one strand of 28 wire for interconnect. However, when going to this smaller gauge wire, the tonal balance of the music shifted upward and the music as a whole seemed to be lacking in weight, but clearly each musical note was more defined and faster sounding, and I perceived more recorded information. I then made up a new sample cable using two strands of 24 gauge wire for the speaker cable and two strands of 28 gauge for the interconnect. With this cable, I heard a greater increase in detail than with a single strand of the larger gauge wire. This was the pivotal moment in which I developed a theory that smaller wire somehow positively changed the sound of the audio signal.

There is a common wire measurement called circular mils. A 26 gauge wire has 252 circular mils and a 22 gauge wire has 640 circular mils. All of the wire demonstration cable that I subsequently made up had all speaker wire combinations totaling as close to 640 circular mils for the speaker cable and 252 circular mils for interconnect cable. I then repeated this experiment using 28 gauge, 30 gauge, 32 gauge, 36 gauge, 38 gauge, 42 gauge, 44 gauge, 47 gauge, 50 gauge, 53 gauge, and 56 gauge wires. These circular mil equivalents are only approximations and can be varied by the electrical load requirement based on the distance required to carry the signal. Every wire gauge tested totaled these amounts of circular mils for each speaker and interconnect cable, respectively. Starting with the smaller strands of wire I then decided to use the same gauge of wire for both the speaker and the interconnect cables, varying only the number of strands of wire to equal required circular mils to have the proper weight of music for the specified component, speaker, or electronic component. For example, a 36 gauge wire required ten strands for an interconnect cable and 26 strands for a speaker cable. A 50 gauge wire required 250 strands for an interconnect cable and 640 strands for a speaker cable. A 56 gauge wire required 1050 strands for an interconnect cable and 3100 strands for a speaker cable.

As I used smaller gauges of wire, the sound improved in a predictably identifiable way. I could hear more detail, more decaying of instruments in the space in each recording venue. I could predict the degree of improvement from each successively smaller gauge wire before I made a cable to use in the system for listening. As I listened to cables made with ever smaller gauges of wire, the wire was getting so small that I had to create a way to take the wire off of the spools it came on. I had placed two nails into my deck rail so that I could use it to take the wire from the spools.

When I went below 40 gauge wire with my prototype cables it was difficult to remove the wire from the spools without breaking it. I devised a wheel that was eleven feet in circumference and built a stand to hold the spool horizontally, with a guide that allowed me to use electrical tape to stick to the wire, feed through the guide, and then place the wire on this wheel with a 4" wide white vinyl molding so that I could see when these fine gauge wires were in fact going on the wheel. For example, a 56 gauge wire is so small that it can only barely be seen by the naked eye. I had to focus lights close to where the wire was while still tightly wound on the spool to be able to attach a small piece of electrical tape to the wire. This was done because the smallest gauges are not readily visible with the naked eye. After I placed the wire onto the tape and through the small wire guide, I only knew that the wire was actually going onto the wheel when I saw a few strands on the white vinyl flat molding as the wheel turned each revolution. I had to place a light directly next to the guide so that I could just see a small reflection of the shiny enamel coating on the wire as it came off the spool, as it went through the guide and onto the wheel.

It was necessary to check constantly to see if the wire had broken while it was being taken from the spool. I purchased an electronic counter and attached a piece of wood on the wheel to strike the counter lightly as each revolution was completed. I could then look at the counter and see how many strands of wire had been placed onto the wheel. The wire could not be viewed in the smallest gauges going onto on the wheel directly, but the body of wires became bigger on the wheel as more strands were applied. The only way it could be determined that the wire had not broken was by looking at the wire guide with a bright light next to it. The wire coming off the spool at approximately 15 feet per second could be barely viewed even in this manner and, without the light, could not be viewed at all indoors without direct sunlight.

If two vinyl insulated wires are placed on top of each other and taped for a distance of approximately four feet, the signal inducts a current flow from one wire to the other, through the insulation. My Uncle told me, when I asked him, as a young man, how to splice a stereo tuner 300 Ohm lead onto my television's 300 Ohm lead. I didn't want the signal to induct from one wire to the other and meander down my last 56 gauge prototype wire back and forth, creating a non-exact signal transference. To address this, I randomized the wire with my fingers similar to the way a woman rats her hair with a comb so that it does not lie flat and parallel. I did this before I placed the wire inside of a Teflon® tubing I had purchased. The tubing adds strain relief to this very fragile wire bundle. After listening to several gauges of wire larger than 26 gauge and 22 gauge for interconnect and speaker cable, every successive smaller gauge of wire that was made into prototype cables produced the same degree of linear improvement. After listening to a variety of eighteen different gauges of successively smaller wire made into interconnect and speaker cable it became apparent that, although different wire stranding and insulation techniques alter the sound, it is the gauge of wire, whether the wire made of copper, silver, or some ultra-pure composition, that is the determining factor to establish the ultimate potential of a cable.

My last test to determine the possibility of signal loss over several connections was to compare the sound directly from a high quality digital-to-analog converter (Benchmark Media Systems Dac 1) that has a built-in headphone output with a volume control. The digital-to-analog converter was connected to Sennheiser HD600 headphones, which are highly regarded in the audio field, and to my stereo and speaker system. From the Digital to analog converter the signal was passed through the following signal path:

1. Through my cable;
2. To a B&K audio video receiver;
3. Through my speaker cable;
4. Through a speaker system external crossover;
5. Through my internal speaker wire; and
6. To my speaker system drivers.

There was no apparent loss of signal fidelity or recorded information. Most importantly, the sound of each note had the same length and texture, indicating the signal arrived with no noticeable degradation or smearing. The only difference that could be detected was based upon the individual sound of the headphone drivers and the individual sound of the speaker drivers. The same level of identical recorded information could be heard from the speaker system as through the headphones. This type of critical listening experiment, to my knowledge, has never successfully been done before.

Critical Understanding and A Speculative Theory Explaining Why and How It Works

I believe that there is a theoretical reason why each gauge starting with AWG 20 to AWG 60, the smallest theoretical wire that can be drawn, becomes more accurate and precise as each smaller wire is tested. Each independent strand of wire forces the sine wave, which looks like an inverted sideways S, and which carries the audio signal, to operate within the constraints of each individual wire. For example, a 3000 Hz sine wave repeats its cycle 3000 times per second and travels closer to the surface of a wire than a 20 Hz note, which repeats itself twenty times per second and travels further from the surface, because of its amplitude, than the higher frequency note. Starting with gauge 40 wire and higher, listening tests indicate that the sine wave is forced to travel more precisely through the wire as it gets smaller. Most wire manufacturers don't make wire smaller than 40 gauge, unless they need the extra flexibility that it provides.

Think of a swirling stream that is being forced into a culvert during a rainstorm. sloshes around in a random fashion, going up and down and back and forth in the pipe as it progresses through the pipe. The water cannot travel in a linear fashion within the pipe and cannot enter the pipe and exit at a constant rate because the water is allowed to deviate from a precise path that a smaller pipe would create. In geometry, the shortest distance between two points is a straight line. As the water goes through the large pipe it continues to undulate and swirl in an random fashion. The cable that I invented literally forces the sine wave into a more precise, linear pattern that makes each note audibly more accurate sounding. This exact phenomena can be heard when alternating current is forced through the same ultra fine wire. The sound coming from an audio source such as a CD player or amplifier, when supplied with power through this wire, is more refined and detailed sounding. As the wire in my cable reaches 50 AWG in size, it is so small that it can be barely seen with the naked eye. It has a diameter of 0.00099 inches and, with an enamel coating to eliminate oxidation, over 339,000 feet of this wire can be placed on a one pound spool. This is over 64 miles of wire. Unlike cables having larger gauge wires, high frequencies are smoother, less harsh and more detailed, low bass frequencies are faster and pitch definition is much more apparent in my cables. This allows the original source sine wave to arrive precisely at its destination. This precise sound is evidenced by each note sounding shorter than its smeared counterpart in conventional cables. My testing verified this phenomena, i.e. the smaller the wire, the more precise sounding sine wave passing through it. As I tested with each smaller gauge wire, I was able to predict exactly what improvements would be achieved before I listened to successive test cables. I made up interconnect and speaker cables with all of the previously listed gauges of wire which included 12 to 56 AWG.

FIG. 1 is a schematic diagram showing a cable including a plurality of metal strands of the same wire size 12 according to the invention.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. An acoustically transparent stranded cable, consisting of:

a plurality of metal wire strands;

wherein each strand comprises a wire size selected from AWG numbered gauge wire sizes 40, 41, 42, 43, 44, 45, 46, 47, 48, 49, 50, 51, 52, 53, 54, 55, 56, 57, 58, 59, and 60;

wherein all strands comprise the same wire size; and wherein 250-1050 strands are used for an interconnect cable and 640-3100 strands are used for a speaker cable.

2. The cable of claim 1 further comprising:

each strand being individually insulated with a solderable enamel coating to prevent surface oxidation.

3. The cable of claim 1, further comprising:

a cable shield.

4. The cable of claim 1, wherein said strands are braided in a predetermined Litz wire configuration to provide a selected number of twists per unit of cable length.

5. The cable of claim 1, further comprising:

a dielectric jacketing.

6. The cable of claim 1, wherein said strands are braided in a random fashion.

* * * * *